US006550090B1

(12) United States Patent
Jesadanont et al.

(10) Patent No.: US 6,550,090 B1
(45) Date of Patent: Apr. 22, 2003

(54) SURFACE SCRUBBING MACHINE

(76) Inventors: Mongkol Jesadanont, 386/2 Ratchadaphisek 42, Ratchadaphisek Rd., Chatuchak, Bangkok 10900 (TH); Apijade Jesadanont, 386/2 Ratchadaphisek 42, Ratchadaphisek Rd., Chatuchak, Bangkok 10900 (TH); Sukanya N. Jesadanont, 386/2 Ratchadaphisek 42, Ratchadaphisek Rd., Chatuchak, Bangkok 10900 (TH)

( * ) Notice: Subject to any disclaimer, the term of this patent is extended or adjusted under 35 U.S.C. 154(b) by 0 days.

(21) Appl. No.: 09/598,330

(22) Filed: Jun. 21, 2000

(51) Int. Cl.[7] ..... A47L 1/02
(52) U.S. Cl. ..... 15/50.3; 15/103; 15/302
(58) Field of Search ..... 15/50.1, 50.3, 15/52.1, 302, 320, 103

(56) References Cited

U.S. PATENT DOCUMENTS

| | | | | |
|---|---|---|---|---|
| 3,604,049 | A | 9/1971 | Hetman | 15/302 |
| 4,025,984 | A | 5/1977 | Hoener, Jr. | 15/302 |
| 4,112,535 | A | 9/1978 | Wild et al. | 15/302 X |
| 4,136,419 | A | 1/1979 | Hetman et al. | 15/302 |
| 4,198,724 | A | 4/1980 | Fisher et al. | 15/302 |
| 4,797,969 | A | 1/1989 | Caduff | 15/302 |
| 4,800,607 | A | 1/1989 | Fukutomi | 15/103 |
| 5,465,446 | A | 11/1995 | Chang | 15/50.3 |
| 5,655,247 | A | 8/1997 | Allen et al. | 15/103 |
| 5,715,557 | A | 2/1998 | Hsu | 15/50.3 |
| 5,890,250 | A | 4/1999 | Lange et al. | 15/50.3 |

FOREIGN PATENT DOCUMENTS

| | | | |
|---|---|---|---|
| JP | 53-139359 | 12/1978 | 15/320 |
| JP | 1-163517 | 6/1989 | 15/52.1 |
| JP | 5-49554 | 3/1993 | 15/302 |
| JP | 6-90885 | 4/1994 | 15/302 |

*Primary Examiner*—Mark Spisich

(57) ABSTRACT

A machine for cleaning outer wall of a high-rise building pushed by a rotating propeller which is at the back of the machine outside a case having rotating brushes chambers, driven by an engine or a motor to press against a wall to be cleaned comprises: a case divided into chambers having an opened-anterior side where edges of all the chambers having rubber plates or brushes mounted all along their rims. In each chamber, there is a rotating brush (or brushes) for scrubbing where detergent solution or water may be ejected onto the rotating brush. At the back of each chamber there is a tube for draining used liquid away or keeping in a reservoir of the machine. There are steel plates mounted vertically one to the top and one to the bottom of the case, where a rubber plate is mounted horizontally along the top steel plate to help wiping off liquid film left on the surface of the wall. There are ski-shape steel elements mounted thereto, two at the top steel plate and two at the bottom steel plate to help optimizing force exerted by the rotating brush onto the surface. The machine is hung through a cable from the top floor of the building where pulling and shifting the cable helps moving the machine vertically or horizontally along the wall. This is a machine which is moving while cleaning or scrubbing and can work under atmospheric pressure.

1 Claim, 4 Drawing Sheets

SURFACE SCRUBBING MACHINE

BACKGROUND OF THE INVENTION

1. Technical Field of the Invention

The present invention relates to an automatic cleaning machine for outer wall of high-rise buildings either smooth or rough wall with grooves which can vertically or horizontally move during a cleaning action and easy to operate.

2. Description of the Prior Art

At present, cleaning high-rise surfaces such as glass windows, outer wall of high-rise buildings and advertising boards are unavoidable. Yet, there is not any efficient machine for such purpose, U.S. Pat. Nos. 3,604,049, 4,025,984, 4,112,535, 4,136,419, 4,198,724, 4,800,607, and 5,655,147. Manual cleaning using personnel and cleaning tools to be carried with the platform is generally used which is laborious, dangerous, time-consuming and very costly, yet the outcome is not satisfactory since there are many blind spots on the large area which limit the range of manual cleaning. Hazard can also happen by abnormal air turbulance between high-rise buildings. Besides, sun-burning or wind-chilling atmosphere makes it even more difficult to find labors for such work with very high risk.

There have been prior inventions; U.S. Pat. Nos. 5,465,446, 5,715,557 and 5,890,250, which can work automatically. However, their machines can do the cleaning action only when the machines are held in fixed position on the wall by mean of vacuum suction cups where the surface must be very smooth to do so. Therefore, their machines can never do the scrubbing of the surface while moving. In addition, while those inventions of Japanese patents, i.e. 53-139359, 1-163517, 5-49554 and 6-90885 and U.S. Pat. No. 4,797,969; all need the sucking action to create negative pressure that their machines can adsorb against the wall surface before the cleaning action can be performed, it is thus impossible to use those machines mentioned to clean a rough surface like brick wall or cement wall with lots of grooves since there will always be empty spaces for air to continuously flow through and therefore vacuum or enough negative pressure can not be achieved.

The present invention is a machine used to scrub a wall automatically either of a smooth glass surface or on a rough surface like the outer surface of a concrete wall or a brick wall with lots of grooves inbetween each brick with highest efficiency and with no need to create a negative pressure inside the machine to help adsorbing of machine to the wall. This machine can work under an atmospheric pressure and can move either vertically or horizontally at the same time while it is cleaning the surfaces, thereby cleaning can be performed continuously and efficiently and save lots of time and efforts.

SUMMARY OF THE INVENTION

A machine for cleaning outer wall of a high-rise building using a propeller driven by an engine or motor mounted to the back of the machine outside rotating brush chambers to push cleaning rotating brushes against a wall to be cleaned. The machine consists of a case divided into chambers having an opened-anterior side where there arc rubber plates or brushes mounted on all along the chamber edges. Rotating brushes are mounted in each chamber and driven by engine or motor to scrub the wall. Water and/or detergent solution from reservoirs installed within or apart from the machine can be ejected to the rotating brushes. This machine is able to move vertically or horizontally along a wall while cleaning continuously by pulling or shifting cables tied at the top of the case.

DESCRIPTION OF THE PREFERRED EMBODIMENTS

Machine for cleaning outer wall of high-rise buildings is invented to clean outer surface of buildings both those of rough surface like the cement or brick walls and those of thoroughly smooth surface like the glass windows and walls.

The principle in operating this machine and the great advantage over those prior arts is that the machine is moving while cleaning, as it can move along either smooth or rough surface to be cleaned and that cleaning can be done continuously without pause.

A propeller made of wood or metal is installed at the back of the machine outside a case having cleaning rotary brush chambers, whereupon being driven by an engine or a motor, a force is exerted to push the rotating brushes against a wall with no need to create a negative pressure to adsorb the machine to the wall to be cleaned.

Figure 1:
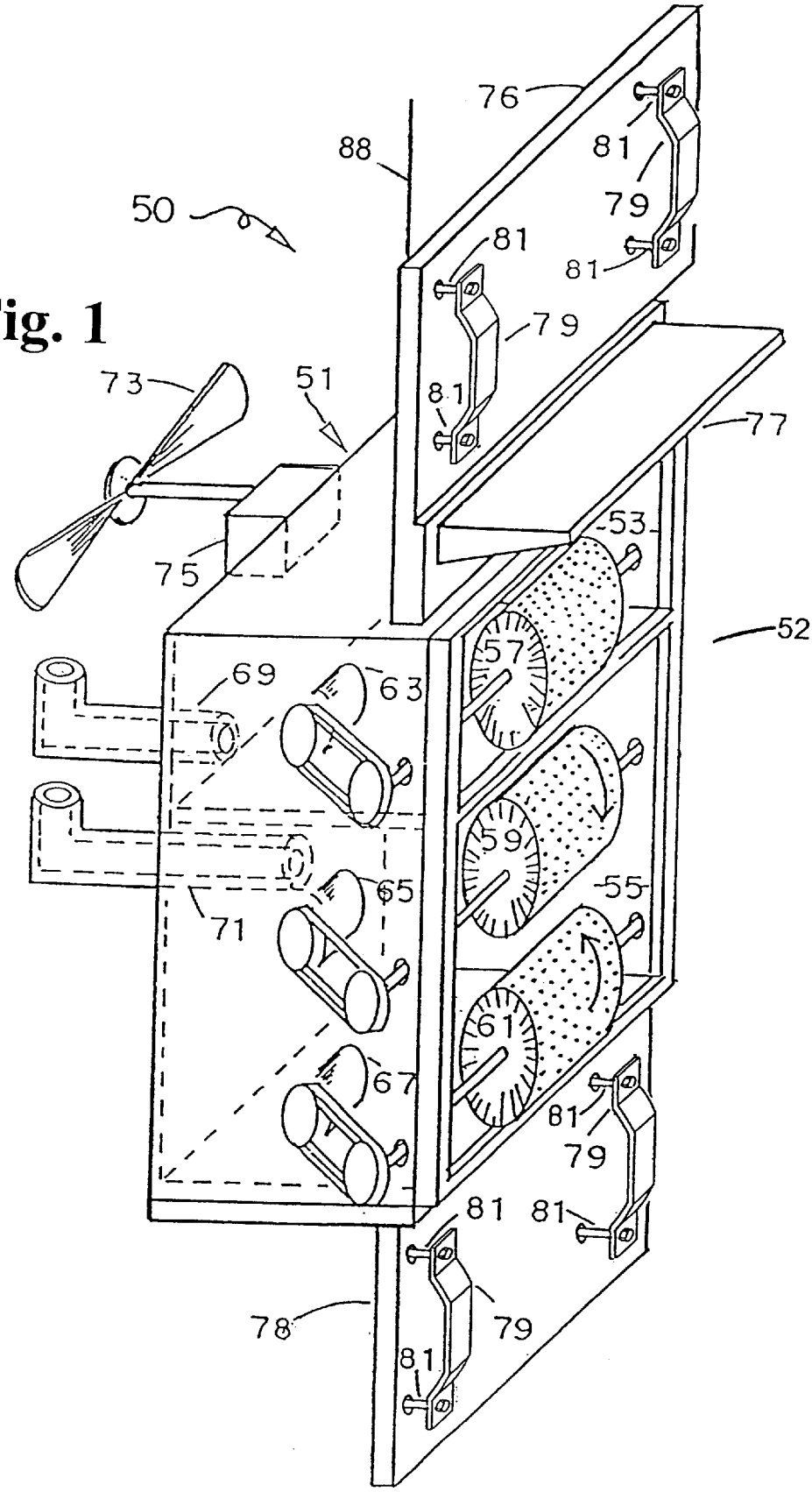
FIG. 1 is an isometric view showing structure of the present invention using a propeller located outside a case having rotating brush chambers driven by an engine mounted to the back to push the machine against a wall.

As shown in FIG. 1, machine 50 is a surface scrubbing machine with a propeller mounted onto comprises case 51 having an opened-side 52 which is an anterior side where all the other sides are closed.

Case 51 is divided into chambers, chamber 53 and chamber 55, having an opened-anterior side where edges of all these chambers having brushes or rubber plates mounted all along their rims which can also perform the scrubbing action or wiping off the liquid from the surface to be cleaned.

In chamber 53, there is a rotating brush 57 driven by motor or engine 63 during an operation.

In chamber 55, there are rotating brushes 59 and 61 driven by motors or engines 65 and 67, respectively.

From the back of chamber 53, water is ejected to rotating brush 57 through tubing 69.

From the back of chamber 55, detergent solution is ejected to rotating brushes 59 and 61 through tubing 71, where water and detergent solution may be kept in a reservoir installed within or apart from case 51.

At the top of case 51, there is a steel plate 76 mounted vertically onto.

There is a rubber plate 77 mounted horizontally at the lower part of steel plate 76, where more than one of rubber plate 77 can also be used parallelly.

On steel plate 76 just above the rubber plate 77, there are 2 ski-shape steel elements 79 (FIG. 2) mounted onto.

At the bottom of case 51, there is a steel plate 78 mounted vertically thereto, with two ski-shape steel elements 79 mounted onto steel plate 78.

The distance of ski-shape steel elements 79 from surface of steel plate 76 or 78 can be adjusted by turning hexagonal-headed bolts 80.

The rotating brushes used for cleaning may also be any other kinds of rotating brushes.

Figure 2:
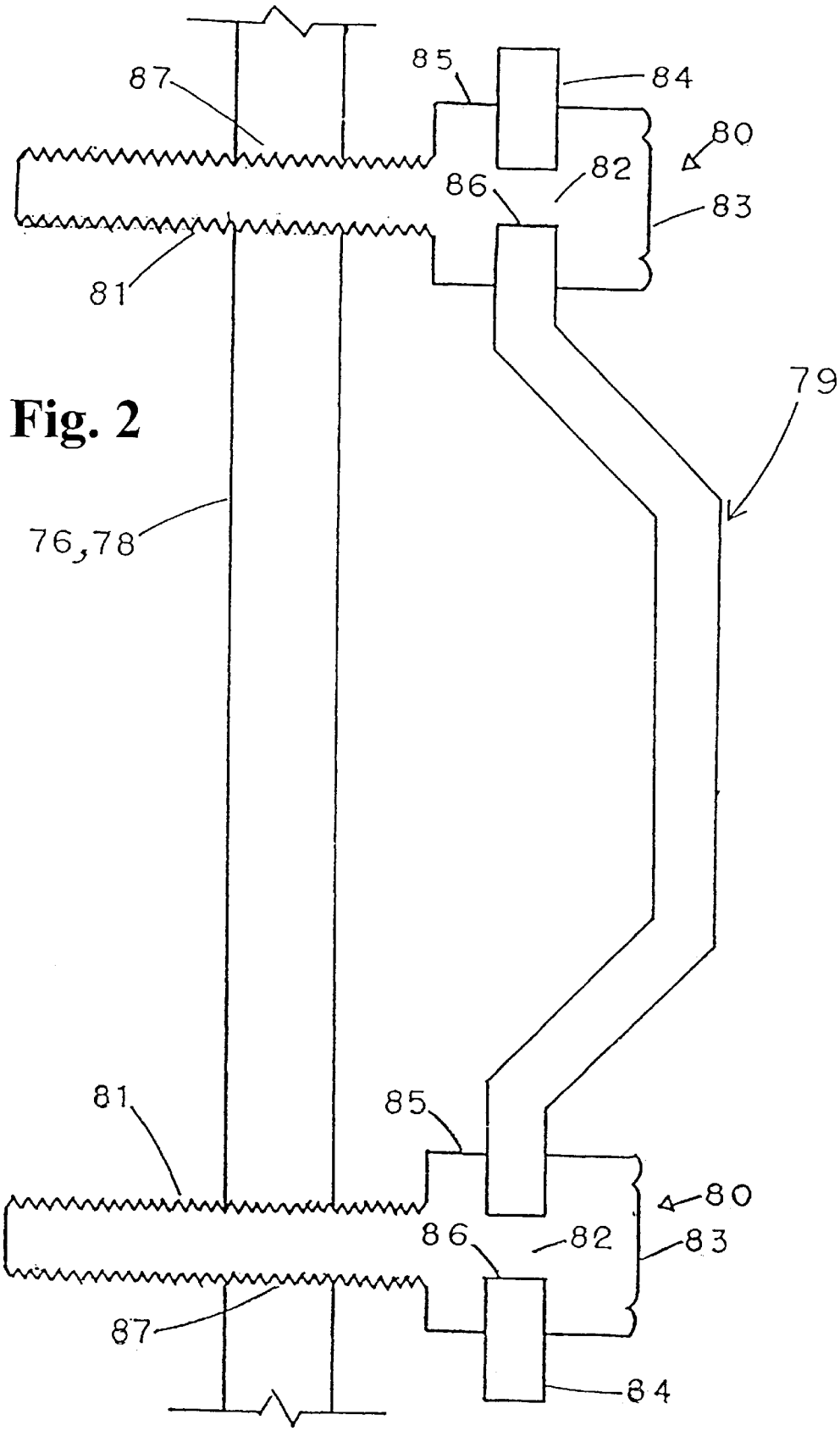
FIG. 2 is a sectional side view of a ski-shape steel plate to be installed at an anterior side of steel plates of the machine to adjust the pushing force of a rotating brush against a wall.

FIG. 2 shows longitudinal sectional view of a ski-shape steel element 79 mounted thereto steel plates 76 or 78 where at each end 84 of element 79 there is a circular hole 86. A hexagonal-headed bolt 80 comprises bolt head 83 and neck 82 with flange 85 and external threads 81. Neck 82 can rotate and is held within circular hole 86 of steel element 79 between bolt head 83 and flange 85.

External threads 81 of bolt 80 mate tightly with internal threads 87 of steel plates 76 and 78. Adjusting the distance between steel clement 79 and steel plate 76 or 78 is possible by turning both bolt-heads 83 at the same time.

Adjusting such distance is performed to optimize the forces exerted by the rotating brush against a wall to be cleaned.

At the back of case 51 outside the rotating brush chambers, there is a propeller 73 which can be driven by engine or motor 75, where more than one propeller can also be used.

Figure 3:
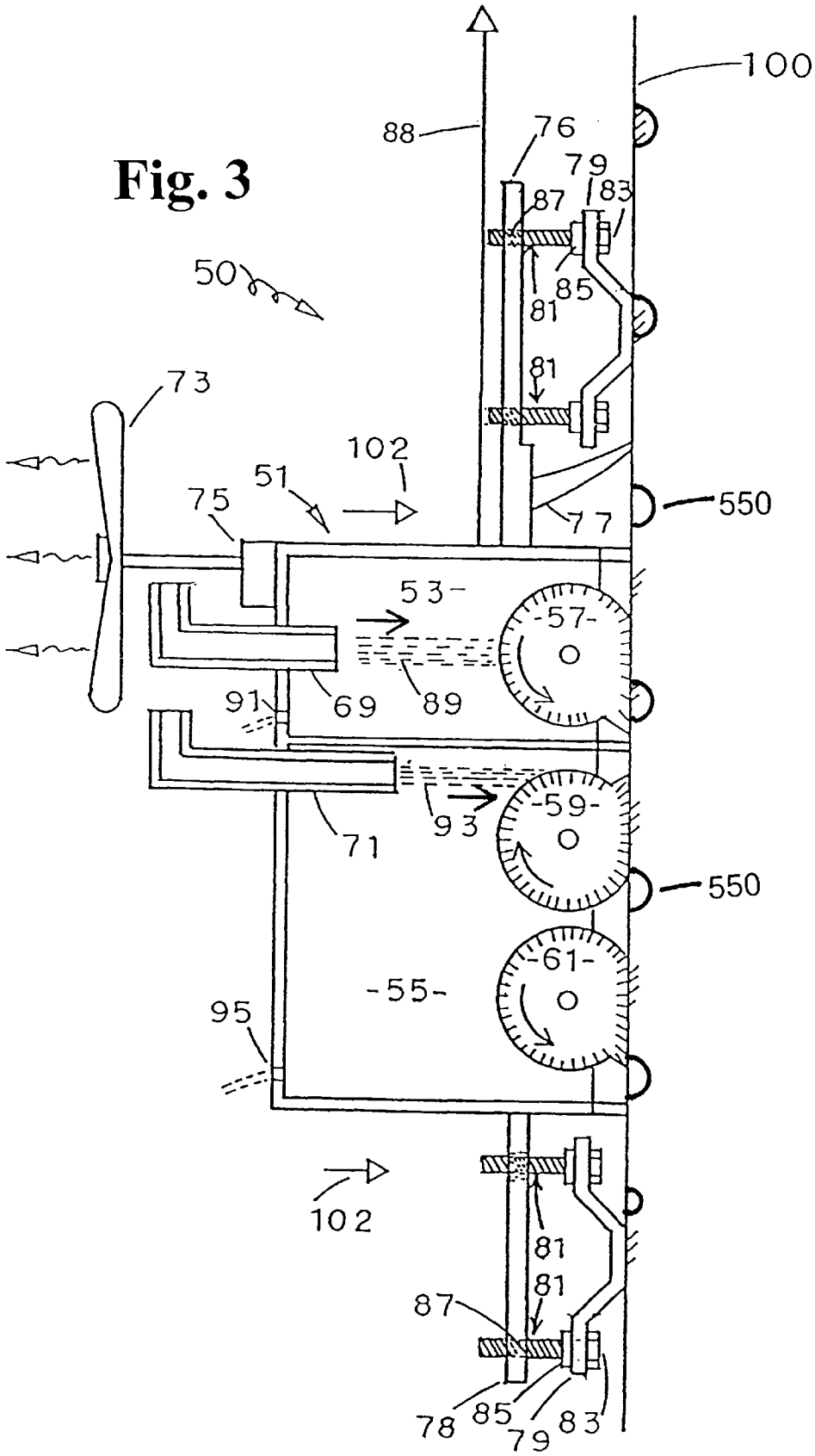
FIG. 3 shows how a scrubbing machine of this propeller type scrubs a wall even with lots of grooves on the wall surface.

To scrub the surface of a wall 100 which may be very smooth surface like glass window or rough surface like brick wall with many grooves 550, as shown in FIG. 3, machine 50 is hung through a cable 88 from the top floor of a building while propeller 73 is driven by engine or motor 75. This forces machine 50 to move in the direction shown by arrow 102 to have steel elements 79 being pushed against a wall 100. At the same time, rotating brushes 57, 59 and 61 rotate and push with optimal force against wall 100. Water jet 89 is ejected from tubing 69 onto rotating brush 57 and detergent solution jet is ejected from tubing 71 onto rotating brushes 59 and 61.

Rotating brushes 59 and 61 scrub and clean wall 100 with detergent solution while rotating brush 57 scrub and wash out the detergent with water. Rubber plate 77 helps wiping off water film left on the surface.

The used liquid in chambers 53 and 55 could be drained away through tubes 91 and 95 or may be kept in a reservoir mounted to the bottom of case 51.

To control the functions of machine 50, a conventional remote control system may be applied.

Figure 4:
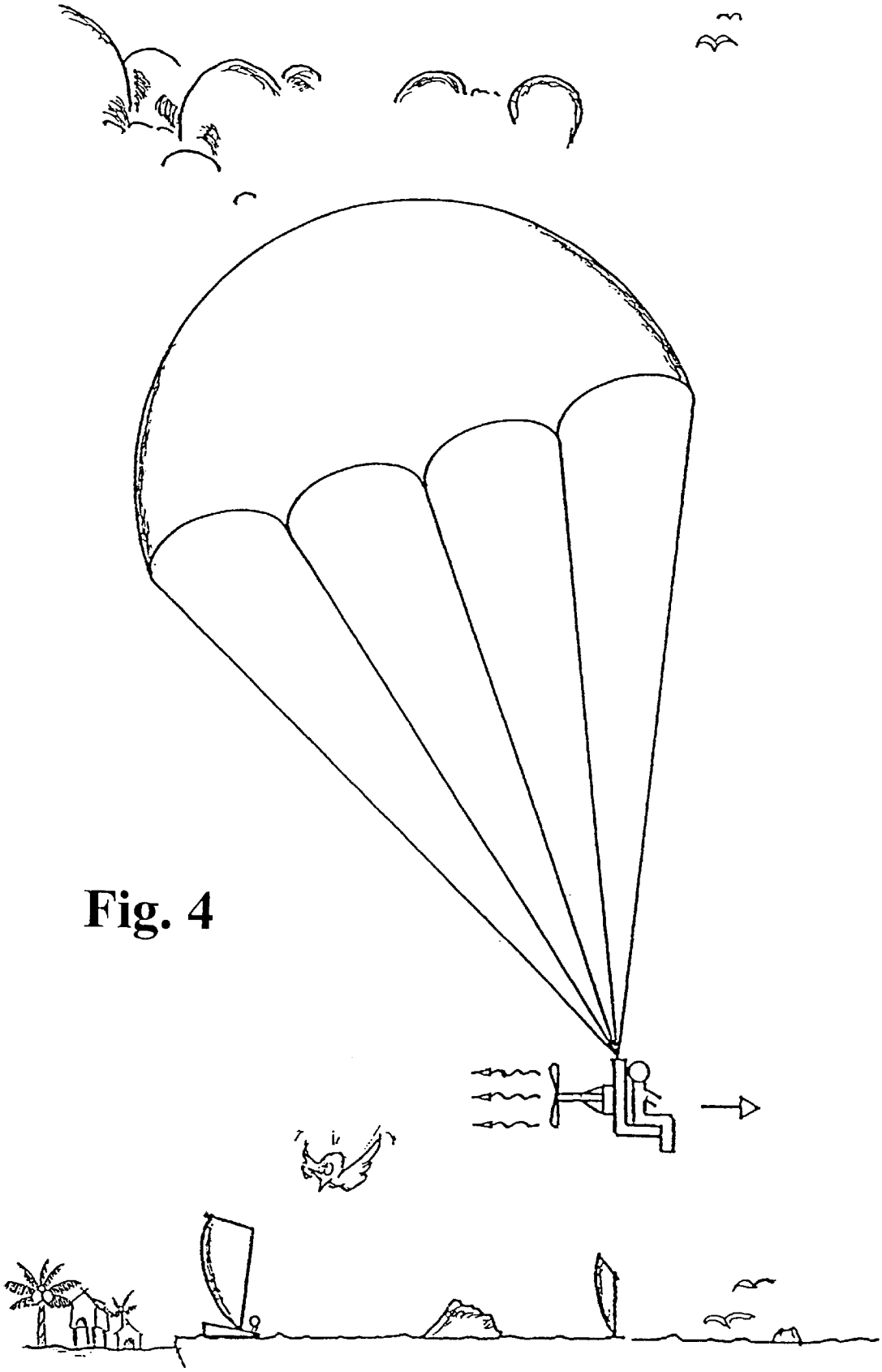
FIG. 4 shows how a flying parachute works as compared with the way the present invention operates.

Machine 50 operates by the rotation of propeller 73 to drive machine 50 against a vertical surface in a manner similar to the way a flying parachute or a paraplane operates as shown in FIG. 4 where a person is suspended in the air via a parachute and a propeller at the back rotates to push the person forward.

It will be understood that changes may be made within the scope of this invention by one of ordinary skill in the art without departing from the spirit thereof. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

We claim:

1. A machine for cleaning the outer wall of a high-rise building, comprising:

a case including a posterior side and an open anterior side divided into chambers with the rims of each chamber at said open anterior side having one of rubber plates and brushes fixed therealong;

a rotatable propeller driven by a driving means, said propeller located at the posterior side of the case for providing a pushing force to the case against the outer wall of the building;

at least one rotary brush mounted in each said chamber, a top chamber including means for supplying a detergent solution to the brush therein and a bottom chamber including means for supplying water to a brush therein;

means for collecting used liquid;

a pair of plates secured to respective top and bottom portions of the case;

an elongated rubber member mounted along the top plate to help wipe off liquid left on the outer wall;

a pair of elongated elements mounted to each of the top and bottom plates, each pair of elongated elements is adjustably secured to the respective plate whereby the relative distance therebetween may be adjusted, whereby the force exerted by the brushes on the outer wall is optimized; and said case is hung by a cable from the top of the building wherein pulling or shifting of said cable helps move the case vertically or horizontally along said wall.

* * * * *